US005829261A

United States Patent [19]

Canellas et al.

[11] Patent Number: 5,829,261

[45] Date of Patent: Nov. 3, 1998

[54] DRIVING ARRANGEMENT FOR AIR REFRIGERATION APPLIANCES

[75] Inventors: Fábio Canellas; Luís Eduardo Poletti, both of Joinville, Brazil

[73] Assignee: Multibras S/A Electrodomesticos, Sao Paulo, Brazil

[21] Appl. No.: 898,471

[22] Filed: Jul. 22, 1997

[30] Foreign Application Priority Data

Aug. 27, 1996 [BR] Brazil ..... 7601296-4 U

[51] Int. Cl.[6] ..... F25D 29/00; F28F 27/00

[52] U.S. Cl. ..... 62/164; 62/180; 236/11

[58] Field of Search ..... 62/180, 186, 164; 165/245; 236/11

[56] References Cited

U.S. PATENT DOCUMENTS 2,731,805 1/1956 Kuhn ..... 62/164

4,041,723 8/1977 Weibel, Jr. et al. ..... 62/180 X 4,667,480 5/1987 Bessler ..... 62/180

*Primary Examiner*—William Wayner

*Attorney, Agent, or Firm*—Darby & Darby

[57] ABSTRACT

A driving arrangement for air refrigeration appliances, of the type comprising a fan (F), a compressor (C), a thermostat (T) and first and second selecting devices (10, 20), which are manually displaceable for activating the fan (F) and compressor (C) and for adjusting the thermostat (T). According to the invention, the first selecting device (10) is displaced along a first portion (1), at the end of which the fan (F) is turned on, a second portion (2), in which only the fan (F) is kept turned on and a third portion (3), in which beginning the compressor (C) is turned on and along which the thermostat (T) is adjusted between a minimum cold condition and a maximum cold condition. The second selecting device (20) has two operative positions, each defining a ventilation regimen for the fan (F).

3 Claims, 1 Drawing Sheet

DRIVING ARRANGEMENT FOR AIR REFRIGERATION APPLIANCES

FIELD OF THE INVENTION

The present invention refers to a driving arrangement for small residential and commercial air refrigeration appliances.

BACKGROUND OF THE INVENTION

According to the prior art, the air refrigeration appliances are driven by a system consisting of two rotatable switches, the first switch selectively controlling five functions, namely: turn off, low ventilation, high ventilation, refrigeration with low ventilation and refrigeration with high ventilation, while the second switch controls the thermostat of the refrigeration system.

The above driving system has two relevant inconveniences. Firstly, due to the large number of functions to be controlled by said first selecting switch, it becomes undesirably complex and consequently of high cost. In the second place, this accumulation of functions in only one control device makes the air refrigeration appliance too vulnerable. If a breakdown occurs in the control of any of the functions, the selecting switch will be impaired and so will the operation of the appliance.

In still another aspect, the control system of the prior art air refrigeration appliances requires simultaneous adjustments of the functions and of the thermostat through said two selecting switches. This will make it difficult for the user to achieve, at each actuation of the appliance, the desired operative condition.

Consequently, when the user finds the ideal operating condition of the appliance, he will tend not to change this adjustment anymore, beginning to turn on and off the appliance by using the circuit breaker through which the appliance is connected to the electrical power source and will create the following problem: when the appliance is turned on by means of its controls, it is absolutely necessary that, as a result of the displacement direction of the selecting switch, the fan motor be firstly turned on before the actuation of the motor of the refrigerating compressor, whereas, when the appliance is turned on by means of the circuit breaker, the simultaneous activation of both devices will occur, causing overload at the start of the appliance.

DISCLOSURE OF THE INVENTION

Thus, it is an object of the present invention to provide a driving arrangement for air refrigeration appliances, which can be easily handled by the user.

It is also an object of the present invention to provide an arrangement as described above and which, once having achieved the prior object, induces the user to operate the appliance through said driving arrangement, thus avoiding the inconveniences related to overload at the restart of the appliance.

It is a further object of the present invention to provide an arrangement as described above, with a lower final cost than that of the prior art driving arrangements.

These and other objectives and advantages of the present invention are achieved by the provision of a driving arrangement for air refrigeration appliances of the type comprising a fan, which is selectively operable between a turned off condition and a turned on condition, in any of at least two ventilation regimens; a compressor, which is selectively operable jointly with the fan; a thermostat, which is adjustable to control the operation of the compressor in function of different temperature ranges which are desired for the environment to be refrigerated; and first and second selecting devices, which are manually displaceable in order to activate the fan, compressor and thermostat.

According to the new arrangement, the first selecting device has a resting position, when the aplliance is turned off, and a total operative displacement comprising a first portion, at the end of which the fan is led to the turned on condition; a second portion, in which only the fan is kept turned on; and a third portion, in which beginning the compressor is turned on and along which the thermostat is adjusted between a minimum cold condition at the beginning of said third portion and a maximum cold condition at the end of said third portion, the second selecting device having two operative positions, each defining a ventilation regimen for the fan.

In practical terms, the driving arrangement for air refrigeration appliances as proposed will allow the user to operate the air refrigeration appliance substantially more easily, thus preventing him from actuating the appliance by using its circuit breaker, consequently protecting said appliance against damages generated from overload caused by the simultaneous activation of both the fan motor and compressor motor.

Moreover, by using a thermostatic switch which controls the activation of the ventilation and refrigeration functions, as well as the thermostat function, and by using an inverting switch which only commands the operating modes of the fan during the low and high ventilation regimens, said arrangement provides a simpler construction, regarding the number of components, as well as of contacts, i.e., electrical connections. Consequently, it provides a substantial cost reduction, as compared to the driving arrangements for air refrigeration appliances of the prior art.

BRIEF DESCRIPTION OF THE DRAWINGS

The invention will be described below, with reference to the attached drawings, in which.

BEST MODE FOR CARRYING OUT THE INVENTION

Figure 1:
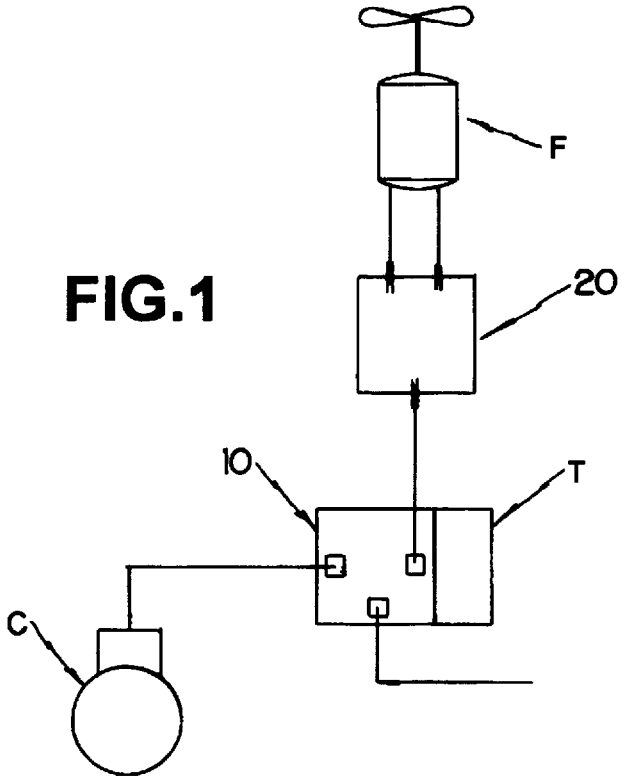
FIG. 1 illustrates a simplified diagram of the new driving arrangement.
Figure 2:
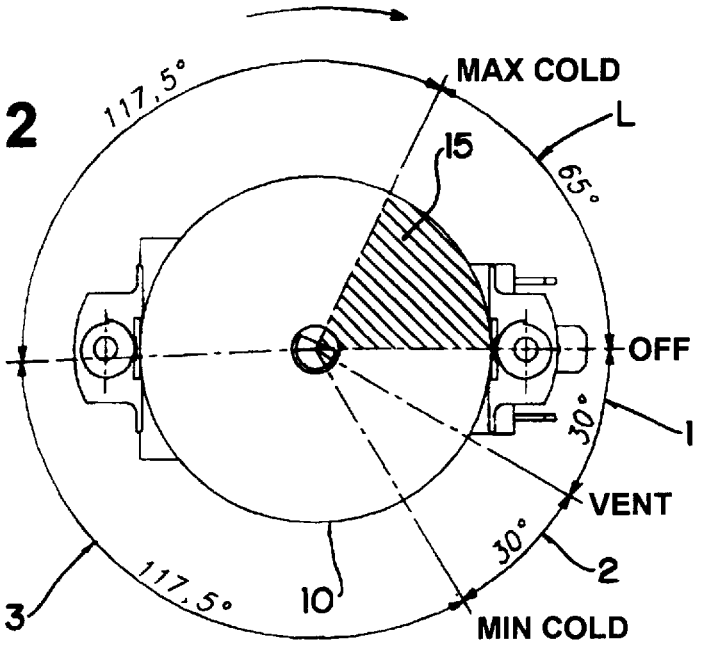
FIG. 2 is a schematic front end view of the selecting device for driving both the fan and the compressor and for adjusting the thermostat.

According to the figures described above, the driving arrangement comprises a first selecting device 10, preferably in the form of a thermostatic switch incorporating a thermostat T and which is rotatable clockwise on a display represented by line L in FIG. 2, between a resting position ("OFF"), in which the appliances are turned off, and a "VENT" (ventilator) position, in which the fan F of the air refrigeration appliance is turned on. This first displacement portion 1 of the selecting device 10 corresponds to a rotation of about 30° on the display L.

From the VENT position, the first selecting device 10 is sequentially turnable along a second displacement portion 2 of approximately 30°, along which only the fan F remains turned on and at the end of which is achieved a "MIN COLD" position, in which the compressor C of the appliance is turned off, the thermostat T is adjusted to the minimum cold position and in which starts a third displacement portion 3 of about 235°, along which the compressor C and fan F remain turned on and the thermostat T is progressively adjusted to lower values of ambient temperature, till reaching the MAX COLD full displacement position of the first selecting device 10, in which the thermostat is adjusted to give the lowest temperature to the environment which is going to be refrigerated and in relation to which the air refrigeration appliance should be adequately dimensioned. At the end of the complete displacement, the first selecting device 10 reaches a stop 15, which is schematically illustrated by the hachured sector in FIG. 2, interrupting its displacement from about 65° of the OFF resting position. The present driving arrangement further includes a second selecting device 20, preferably in the form of na inverting switch of the ON-ON type (push button) having one input and two outputs, allowing the user to select the high or low ventilation regimen to be imparted to the fan.

We claim:

1. A driving arrangement for air refrigeration appliances, of the type comprising a fan (F), which is selectively operable between a turned off condition and a turned on condition, in any of at least two ventilation regimens; a compressor (C), which is selectively operable jointly with the fan; a thermostat (T), which is adjustable to control the operation of the compressor in function of different temperature ranges which are desired for the environment to be refrigerated; and first and second selecting devices (10, 20), which are manually displaceable in order to activate the fan, compressor and thermostat, characterized in that the first selecting device (10) has a resting position, when the apliance is turned off, and a total operative displacement comprising a first portion (1), at the end of which the fan (F) is led to the turned on condition; a second portion (2), in which only the fan (F) is kept turned on; and a third portion (3), in which beginning the compressor (C) is turned on and along which the thermostat (T) is adjusted between a minimum cold condition at the beginning of said third portion (3) and a maximum cold condition at the end of said third portion, the second selecting device (20) having two operative positions, each defining a ventilation regimen for the fan (F).

2. A driving arrangement, as in claim 1, characterized in that the first selecting device (10) incorporates the thermostat (T) in a thermostatic switch and is clockwise rotatable on a display (L), along a first portion (1) of about 30°, a second portion (2) of about 30° and a third portion (3) of about 235°.

3. A driving arrangement, as in claim 1, characterized in that the second selecting device (20) comprises an inverting switch of the ON-ON type, having one input and two outputs.

* * * * *

UNITED STATES PATENT AND TRADEMARK OFFICE

CERTIFICATE OF CORRECTION

PATENT NO. : 5,829,261

DATED : November 3, 1998

INVENTOR(S) : Fábio CANELLAS and Luís Eduardo POLETTI

It is certified that error appears in the above-identified patent and that said Letters Patent is hereby corrected as shown below:

On the title page, item [73] Assignee:

Delete ""Electrodomesticos" and insert therefor -- Eletrodomésticos --.

Signed and Sealed this

Twenty-first Day of March, 2000

*Attest:*

*Attesting Officer*

Q. TODD DICKINSON

*Commissioner of Patents and Trademarks*